US005467536A

United States Patent [19]

Ramer et al.

[11] Patent Number: 5,467,536

[45] Date of Patent: Nov. 21, 1995

[54] SHOE CONSTRUCTION

[76] Inventors: John Ramer, 69 Borrows Rd., Foxboro, Mass. 02035; Richard S. Herman, 30 Magnolia Rd., Sharon, Mass. 02067

[21] Appl. No.: 98,239

[22] Filed: Jul. 29, 1993

Related U.S. Application Data

[63] Continuation of Ser. No. 845,514, Feb. 27, 1992, abandoned, which is a continuation-in-part of Ser. No. 675,282, May 24, 1991, abandoned.

[51] Int. Cl.[6] ..... A43B 13/18; A43B 7/06

[52] U.S. Cl. ..... 36/28; 36/3 B

[58] Field of Search ..... 36/3 B, 3 R, 31, 36/30 R, 25 R, 107, 28

[56] References Cited

U.S. PATENT DOCUMENTS

| | | | |
|---|---|---|---|
| 1,605,408 | 11/1926 | Huiskamp | 36/3 B |
| 1,607,896 | 11/1926 | Kelly | 36/31 X |
| 2,410,530 | 11/1946 | Strong | 36/30 |
| 3,418,731 | 12/1968 | Anciaux | 36/30 R |
| 4,499,672 | 2/1985 | Kim | 36/3 B |
| 4,557,060 | 12/1985 | Kawashima | 36/30 R X |
| 4,564,966 | 1/1986 | Chen | 36/31 X |
| 4,658,516 | 4/1987 | Beck | 36/30 R X |
| 4,794,707 | 1/1989 | Franklin et al. | 36/31 X |
| 4,817,304 | 4/1989 | Parker et al. | 36/28 X |
| 4,860,463 | 8/1989 | Pin | 36/3 B |
| 4,881,328 | 11/1989 | Yung-Mao | 36/107 X |
| 4,905,382 | 3/1990 | Lin | 36/107 X |
| 4,908,962 | 3/1990 | Yung-Mao | 36/28 |
| 4,918,838 | 4/1990 | Chang | 36/28 |
| 4,974,345 | 12/1990 | Yung-Mao | 36/28 X |
| 5,025,573 | 6/1991 | Giese et al. | 36/28 X |
| 5,042,174 | 8/1991 | Nichols | 36/30 R X |
| 5,224,277 | 7/1993 | Do | 36/3 R X |

FOREIGN PATENT DOCUMENTS

| | | | |
|---|---|---|---|
| 9111928 | 8/1991 | WIPO | 36/30 R |

*Primary Examiner*—Paul T. Sewell
*Assistant Examiner*—BethAnne C. Cicconi

[57] ABSTRACT

A shoe construction for cushioning the foot includes a dual density sole having a cavity in the upper surface thereof. The cavity includes an overlapping peripheral edge which engages and interlocks with the biased edge of a nippled insert mounted therein. A midsole having a forefoot cushion overlays the dual density sole and insert combination. An optional cushioning insole and shock-absorbing heel cup increase the comfort of the sole construction.

2 Claims, 4 Drawing Sheets

SHOE CONSTRUCTION

This is a continuation of application Ser. No. 07/845,514 filed on Feb. 2, 1992, now abandoned, which is a continuation-in-part of application Ser. No. 07/675,282 filed May 24, 1991, now abandoned.

BACKGROUND OF THE INVENTION

1. Field of the Invention

This invention relates to shoe construction and more specifically to shoe construction using a nippled insert and a cushion for ease of walking.

SUMMARY OF THE INVENTION

The shoe construction comprises a dual density sole, an interlocking insert, a mid-sole and an upper. The interlocking insert has holes formed therethrough and includes a cavity having a base surface from which nipples extend. The mid-sole has an through aperture formed at the forward part thereof. The through aperture has a cushion mounted therein.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
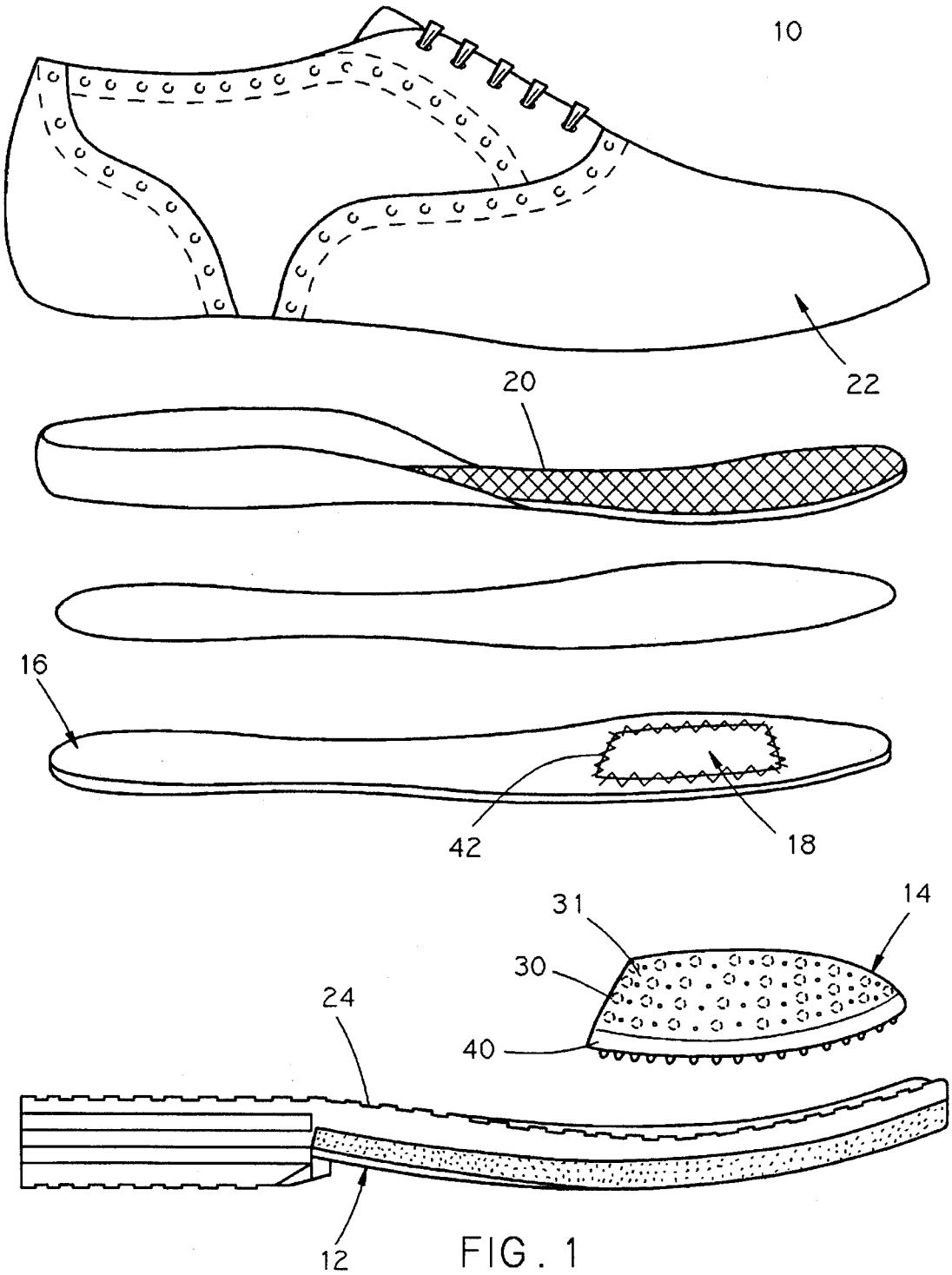
FIG. 1. is an exploded side elevation view of the shoe construction according to the present invention.
Figure 2:
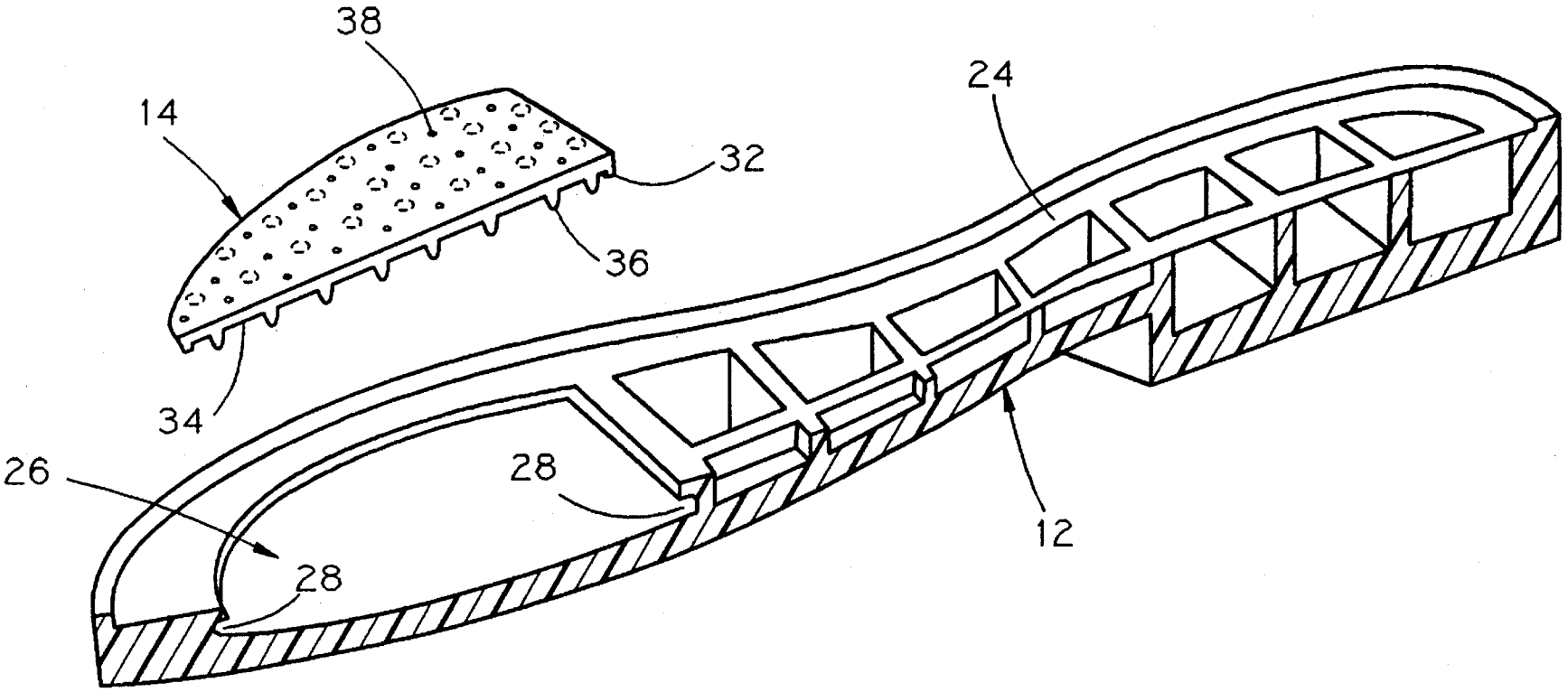
FIG. 2. is a perspective of the dual density sole of the shoe construction shown in FIG. 1.
Figure 3:
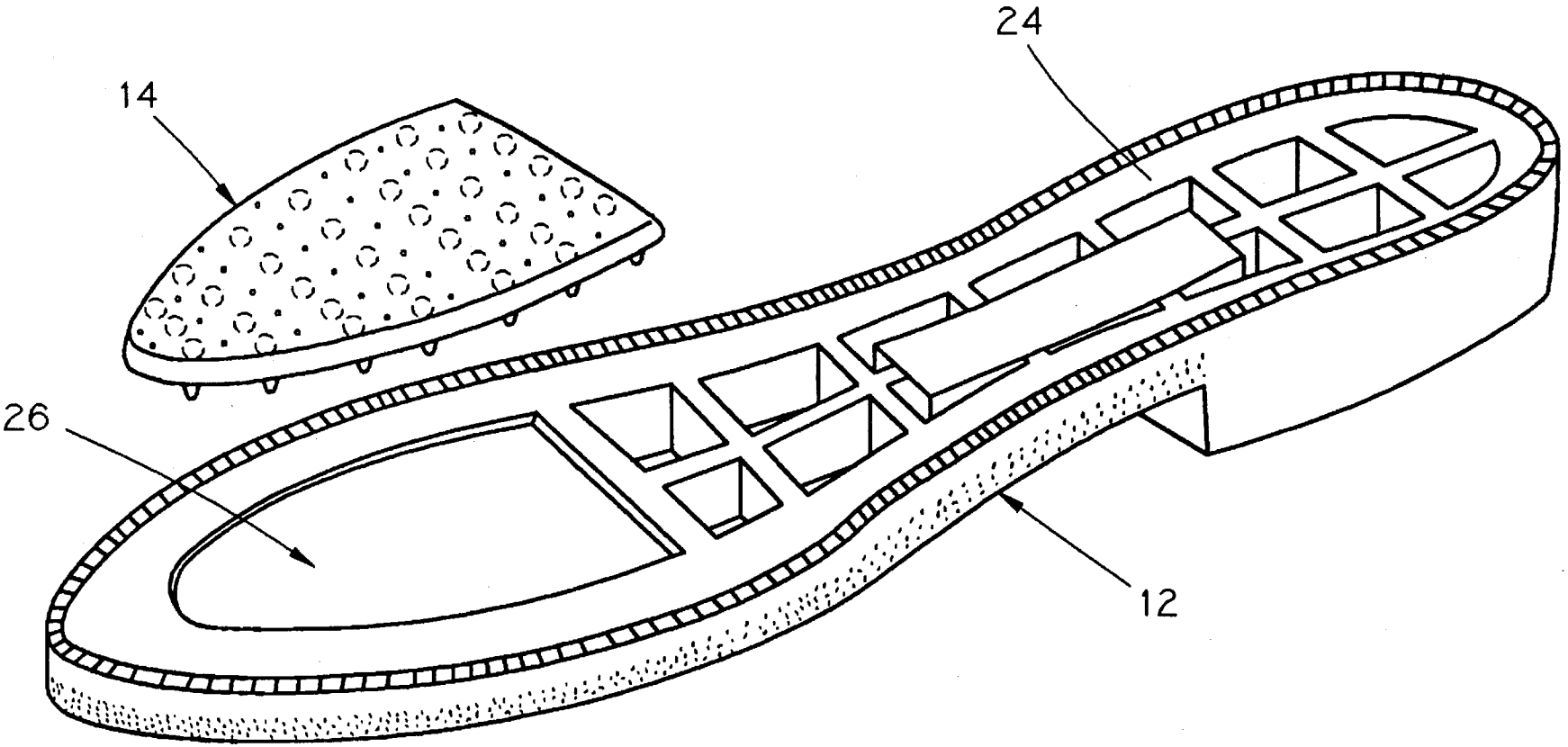
FIG. 3 is a perspective view of the bottom of the interlocking insert of the shoe construction shown in FIG. 1.
Figure 4:
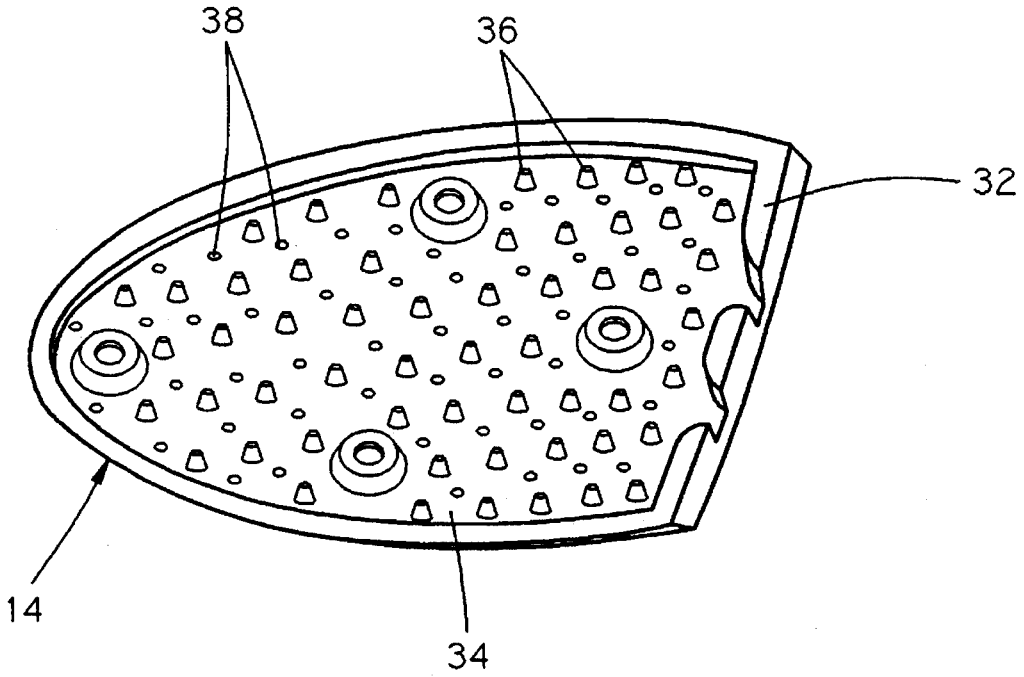
FIG. 4 is a bottom plan view of the insole of the shoe construction shown in FIG. 1.
Figure 5:
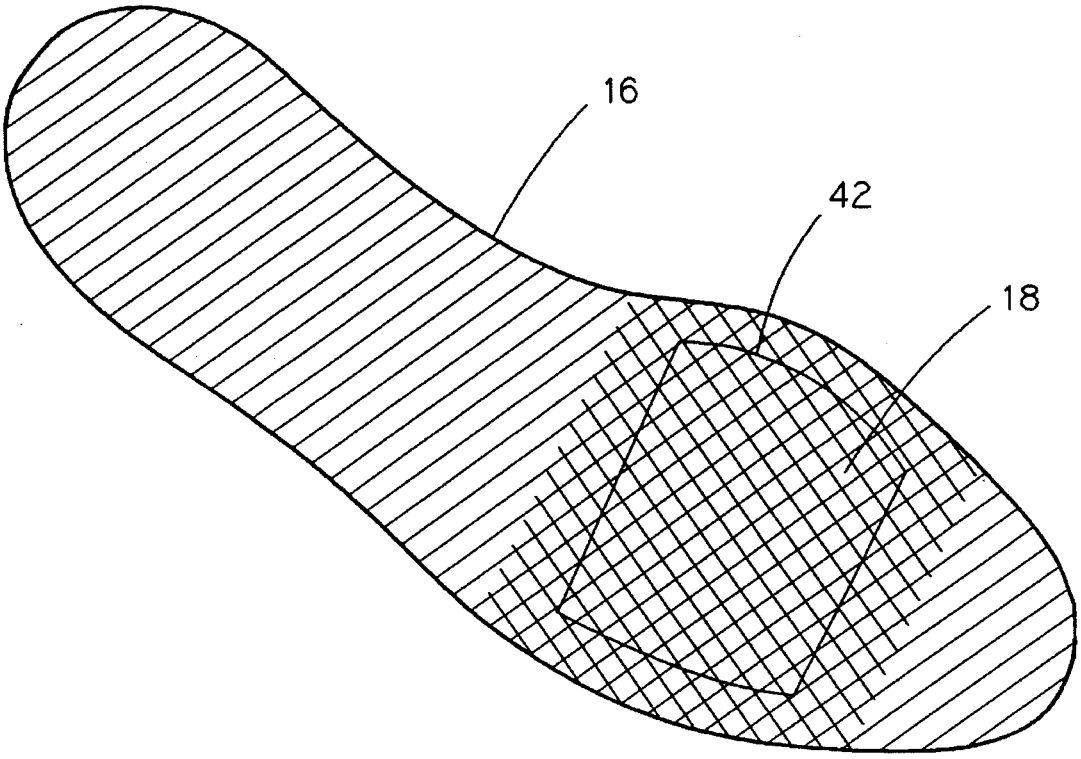
FIG. 5 is a top view of the inner sole board with a fabric laminate over the insole to lock in the cushioning insert, as in FIG. 1.

There is shown in the drawings at FIG. 1 an exploded side elevational view of the applicant's improved shoe construction. Generally the shoe construction 10 comprises a dual density sole 12, an nippled insert 14, a mid-sole 16, a cushion 18, an insole 20 and an upper 22. The dual density sole 12 includes a top surface 24 having a cavity 26 formed therein having the peripheral configuration and a depth equal to or slightly greater than the thickness of the nippled insert 14. The upper edge 28 of the cavity 26 provides an overhang or lip around and proximate the periphery thereof. The nippled insert 14, generally shield like in configuration and formed of a vinyl, comprises a support portion 30 having an upper surface 31 and a lower surface 32. The lower surface 32 has a hollow area 34 formed therein. A series of nipples 36 spaced from each other extend from the lower surface of the hollow area 34. Interspersed among the nipples 36, is a series of holes 38 spaced from each other and from the nipples 36. The peripheral edge 40 of the nippled insert 14 is biased from the upper surface 31 to the lower surface 32 of the nippled insert 14. With the lower surface 32 of the nippled insert 14 facing the cavity 26, the nippled insert 14 is press fitted into the cavity 26 until its upper edge 28 overlaps the peripheral edge 40 of the nippled insert 14. The bias of the peripheral edge 40 and the configuration of the upper edge of the cavity 26 assures a secure fit and ease of engagement.

The mid-sole 16 has a through aperture 42 formed in it at the portion thereof underlying the "ball" of the foot when it worn as part of the shoe construction 10. The cushion 18 is formed of a sponge rubber material which is laminated or sewn into the through aperture 42. The mid-sole 16 is glued or otherwise attached to the top surface 24 of the dual density sole 12 with the cushion 18 overlying in abutting relationship the mounted nippled insert 14. The mid-sole 16 includes top and bottom surfaces. A gauze-like fabric is laminated over the entire bottom surface of the mid-sole 16. This reinforces the mid-sole giving it greater lateral stability. The top surface of the mid-sole 16 over the sub assembly of the cushion 18 and through aperture 42 is laminated with guaze-like fabric to assure that the cushion 18 will not become dislodged during wear.

An insole 20 is attached to the mid-sole 16, in a manner well known in the art, and is formed, if desired, of a cushioning material and a shock absorbing heel cup. The leather upper 22 is attached to the dual density sole 12 completing the shoe construction 10.

We claim:

1. A shoe construction comprising a dual density sole, a nippled insert, a mid-sole and an upper, the nippled insert having apertures formed therethrough, and having an upper surface and a lower surface, the nippled insert having a peripheral edge and having a hollow formed therein, the peripheral edge being biased from the upper surface of the nippled insert to the lower surface thereof, the hollow having a base surface, the base surface having nipples extending therefrom, the dual density sole having a cavity formed therein and having an upper edge around and proximate the periphery of the cavity, the peripheral edge of the cavity overlapping the peripheral edge of the nippled insert, the nippled insert being press fitted into the cavity with the nipples facing the dual density sole, the apertures being spaced from the nipples, the mid-sole being mounted on the dual density sole and the upper being mounted on the dual density sole, the upper defining an open area and the cavity being isolated from the open area, the mid-sole having a forward portion, a through aperture formed at the forward portion thereof, a flexible cushion mounted in the through aperture, and the cushion being in superimposed abutting relation to the nippled insert.

2. A shoe construction comprising a dual density sole, a nippled insert, a mid-sole, a fabric and an upper, the nippled insert having apertures formed therethrough, having an upper surface and a lower surface, the nippled insert having a peripheral edge and the insert having a hollow formed therein, the hollow having a base surface, the peripheral edge being biased from the upper surface of the nippled insert to the lower surface, the base surface having nipples extending therefrom, the dual density sole having a cavity formed therein and having an upper edge around and proximate the periphery of the cavity, the peripheral edge of the cavity overlapping the peripheral edge of the nippled insert, the nippled insert being press fitted into the cavity with the nipples facing the dual density sole, the apertures being spaced from the nipples, the mid-sole being mounted on the dual density sole and the upper being mounted on the dual density sole, the upper defining an open area and the cavity being isolated from the open area, the fabric being attached to and covering the bottom surface of the mid-sole.

* * * * *